United States Patent [19]

Pate et al.

[11] Patent Number: 4,603,074

[45] Date of Patent: Jul. 29, 1986

[54] VINYL CHLORIDE POLYMER LAMINATE

[75] Inventors: Joseph L. Pate; Dalton I. Windham, Jr., both of Columbus, Miss.

[73] Assignee: Gencorp Inc., Akron, Ohio

[21] Appl. No.: 736,731

[22] Filed: May 22, 1985

[51] Int. Cl.[4] ..... B32B 3/30; B32B 27/06

[52] U.S. Cl. ..... 428/172; 427/331; 427/365; 427/372.2; 427/374.4; 427/385.5; 427/407.1; 428/286; 428/287; 428/482; 428/483; 428/524; 428/904.4

[58] Field of Search ..... 428/172, 287, 904.4, 428/482, 483, 524, 286; 427/372.2, 374.1, 407.1, 385.5, 365, 299, 331

[56] References Cited

U.S. PATENT DOCUMENTS

| | | | |
|---|---|---|---|
| 4,129,547 | 12/1978 | Noyes | 428/524 |
| 4,158,073 | 6/1979 | Schneider | 428/172 |
| 4,187,131 | 2/1980 | Shortway et al. | 428/172 |
| 4,303,695 | 12/1981 | McCann | 428/172 |
| 4,359,500 | 11/1982 | Schweitzer | 428/524 |
| 4,404,332 | 9/1983 | Parekh et al. | 428/524 |

*Primary Examiner*—Paul J. Thibodeau

[57] ABSTRACT

A compounded and plasticized vinyl chloride polymer layer, optionally supported such as with a fabric, contains an outer adherent and stain resistant layer having durability and flexibility comprising the crosslinked reaction product of a reactive polyester having free carboxylic acid groups and an alkylated benzoguanamine-, urea- or melamine-formaldehyde resin. The vinyl chloride layer may be printed or embossed or both printed and embossed, optionally printed again, before the outer layer is applied.

24 Claims, 1 Drawing Figure

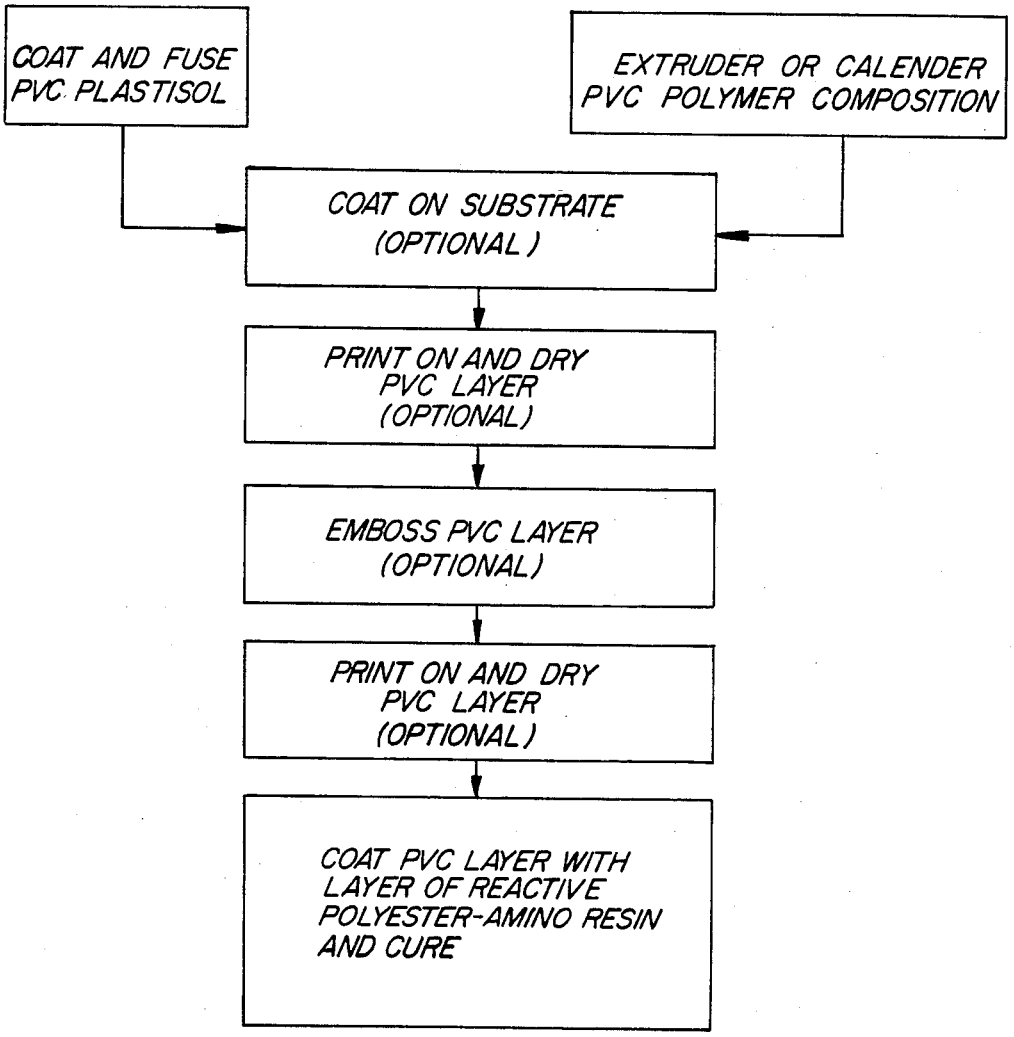
COAT AND FUSE PVC PLASTISOL
EXTRUDER OR CALENDER PVC POLYMER COMPOSITION
COAT ON SUBSTRATE (OPTIONAL)
PRINT ON AND DRY PVC LAYER (OPTIONAL)
EMBOSS PVC LAYER (OPTIONAL)
PRINT ON AND DRY PVC LAYER (OPTIONAL)
COAT PVC LAYER WITH LAYER OF REACTIVE POLYESTER-AMINO RESIN AND CURE

VINYL CHLORIDE POLYMER LAMINATE

This invention relates to vinyl chloride polymer laminates and unsupported films having improved stain resistance.

OBJECTS

An object of this invention is to provide a vinyl chloride polymer laminate and unsupported film having improved stain resistance.

Another object of this invention is to provide a method for making a vinyl chloride polymer laminate and unsupported film having improved stain resistance.

These and other objects and advantages of the present invention will become more apparent to those skilled in the art from the following detailed description and accompanying drawing which is a flow chart showing methods for making a stain resistant vinyl chloride polymer (PVC) laminate or unsupported film.

SUMMARY OF THE INVENTION

According to the present invention a layer of a flexible vinyl chloride polymer is coated with a catalyzed reactive polyester-amino resin composition in solvent and heated to cure and adhere the resin to the vinyl chloride polymer layer with removal of the solvent to provide the flexible vinyl chloride polymer layer with a coating which is stain resistant or which can readily be cleaned to remove stains.

As shown in the accompanying drawing which represents embodiments of the present invention a vinyl chloride polymer plastisol is coated and fused or a plasticized vinyl chloride polymer composition is calendered or extruded. They may be applied to a substrate or support. In either case the vinyl chloride polymer layer (about 1 to 30 mils thick) can be printed one or more times. Then the printed layer is embossed, optionally printed again, and finally coated with a layer of a solution of a reactive polyester-amino resin composition and cured to provide the vinyl chloride polymer layer with an outer stain resistant layer about 0.1 to 2 mils thick.

BRIEF DESCRIPTION OF THE DRAWINGS

The FIGURE shows a block diagram of the process of the invention.

DISCUSSION OF DETAILS AND PREFERRED EMBODIMENTS

The vinyl chloride polymer can be an emulsion (plastisol grade) or a suspension grade vinyl chloride polymer. The vinyl chloride polymer can be homopolyvinyl chloride (preferred) or a copolymer of a major amount by weight of vinyl chloride and a minor amount by weight of a copolymerizable monomer selected from the group consisting of vinyl acetate, vinylidene chloride and maleic ester. Bulk and solution vinyl chloride polymers, also, may be used. Mixtures of vinyl chloride polymers can be used. Vinyl chloride polymers and copolymers are well known. In this connection please see "Vinyl and Related Polymers," Schildknecht, John Wiley & Sons, Inc., New York, 1952; Sarvetnick, "Polyvinyl Chloride," Van Nostrand Reinhold Company, New York, 1969; Sarvetnick, "Plastisols And Organosols," Van Nostrand Reinhold Company, New York, 1972 and "Modern Plastics Encyclopedia 1980–1981," October, 1980, Volume 57, No. 10A, McGraw-Hill Inc., New York.

The amount of plasticizer used to plasticize the vinyl chloride polymer to make it flexible may vary from 30 to 100 parts by weight per 100 parts by weight of total vinyl chloride polymer resin. Examples of plasticizers which may be used are butyl octyl phthalate, dioctyl phthalate, hexyl decyl phthalate, dihexyl phthalate, diisooctyl phthalate, dicapryl phthalate, di-n-hexyl azelate, diisononyl phthalate, dioctyl adipate, dioctyl sebacate, trioctyl trimellitate, triisooctyl trimellitate, triisononyl trimellitate, isodecyl diphenyl phosphate, tricresyl phosphate, cresyl diphenyl phosphate, polymeric plasticizers, epoxidized soybean oil, octyl epoxy tallate, isooctyl epoxy tallate and so forth. Mixtures of plasticizers may be used.

Other vinyl chloride polymer compounding ingredients are desirably incorporated in the vinyl chloride polymer compositions. Examples of such ingredients are the silicas such as precipitated silica, fumed colloidal silica, calcium silicate and the like, calcium carbonate, ultra violet light absorbers, fungicides, carbon black, barytes, barium-cadmium-zinc stabilizers, barium-cadmium stabilizers, tin stabilizers, dibasic lead phosphite, $Sb_2O_3$, zinc borate and so forth and mixtures of the same. $TiO_2$, red iron oxide, phthalocyanine blue or green or other color pigments can be used. The pigments and the other dry additives preferably are dispersed or dissolved in one or more plasticizers before adding to the plasticized vinyl chloride polymer compositions. These compounding ingredients are used in effective amounts by weight to control color, mildew, stabilization, viscosity and so forth of the plasticized vinyl chloride polymer.

The vinyl chloride polymer composition may contain suitable blowing or foaming agents such as sodium bicarbonate, and the organic agents like 1,1'-azobisformamide, 4,4'-oxybis(benzene sulfonylhydrazide), p-toluenesulfonyl hydrazide and so forth to form a cellular or foamed vinyl chloride polymer composition layer or sheet on fusing. The blowing agents may require an activator. Such blowing agents are well known.

Vinyl chloride polymer blending or extender resins, also, can be used in the compositions in a minor amount by weight as compared to the vinyl chloride polymer composition.

The ingredients forming the vinyl chloride polymer composition may be charged to and mixed together in any one of several mixing devices such as a Ross Planetary mixer, Hobart dough type mixer, Banbury, 2-roll rubber mill, Nauta mixer and ribbon blender and so forth.

The vinyl chloride polymer composition can be formed into layers or films which can be unsupported or supported (preferred). Where a vinyl chloride polymer plastisol composition is used, it may be cast on a release surface and heated to fuse it to form a film. Where a plasticized suspension grade vinyl chloride polymer composition is used, it can be calendered or extruded and fused to form a film. Temperatures may vary from about 200° to 400° F. However, it is preferred that in either case the compounded vinyl chloride polymer compositions be supported or have a backing. In the case of the supported vinyl chloride polymer composition, the substrate can be a woven fabric (drill, scrim, cheesecloth, and so forth), a knit fabric, a non-woven fabric, paper etc. The fabric can be made of cotton, cellulose, nylon, polyester, aramid, rayon or acrylic fibers or cords or mixtures of the same. It may be necessary in some instances to treat the fabric with an adhesive coating or dip to adhere or to adhere better the fabric to the vinyl chloride polymer composition.

The vinyl chloride polymer composition film or layer, supported or unsupported, is preferably printed on the surface of the vinyl chloride polymer with a suitable vinyl chloride polymer receptive ink to form desirable and novel patterns and designs. Such inks are well known and can be applied by various methods of printing such as by gravure, flexography, screen printing, jet printing, web printing and so forth. See "Modern Plastics Encyclopedia 1980–1981," pages 464–465. The printing operation may be repeated for up to five times or more to vary the colors and designs at temperatures of from about 150° to 165° F. for each printing step.

The vinyl chloride polymer composition film or layer, supported or unsupported, printed or unprinted, is preferably embossed to texture the vinyl chloride layer to provide a pattern or design for esthetic or functional purposes. Embossing of thermoplastic films, layers or sheets is well known and is usually carried out by passing the film between an embossing roll and a backup roll under controlled preheating and postcooling conditions. See "Modern Plastics Encyclopedia 1980–1981," pages 454–455. Additional decorating or printing can sometimes be done with the above stated inks over the embossed vinyl chloride polymer surface for better aesthetic purposes.

The reactive polyester-amino resin for use as the outer or top coating on the vinyl chloride polymer layer is prepared from a solution of a reactive polyester (alkyd resin) and an amino resin in an organic solvent such as methyl ethyl ketone containing a catalyst and is applied at a temperature of at least about 200° F. to cause curing or crosslinking of the alkyd resin and the amino resin. The reactive polyester-amino resin solvent composition may be applied to the vinyl chloride polymer composition film directly, with or without the backing or substrate, with or without the printing steps and with or without the embossing step. It is preferred that the catalyzed reactive polyester-amino resin solution be applied to an embossed and printed compounded and plasticized vinyl chloride polymer composition carried on a suitable backing or substrate.

The polyester resins (alkyd resins) are made by a condensation polymerization reaction, usually with heat in the presence of a catalyst, of a mixture of a polybasic acid and a polyhydic alcohol. Fatty monobasic oils or fatty acids, monohydroxy alcohols and anhydrides may be present. They, also, contain active hydrogen atoms, e.g., carboxylic acid groups for reaction with the amine resin. Example of some acids to use to form the alkyd resin or reactive polyester are adipic acid, azelaic acid, sebacic acid, terephthalic acid and phthalic anhydride and so forth. Examples of some polybasic alcohols to use are ethylene glycol, propylene glycol, diethylene glycol, dipropylene glycol, glycerine, butylene glycol, 2,2-dimethyl-1,3-propanediol, trimethylol propane, 1,4-cyclohexanedimethanol, pentaerythritol, trimethylolethane and the like. Mixtures of the polyols and polycarboxylic acids can be used. Examples of a suitable reactive polyester to use is the condensation product of trimethylol propane, 2,2-dimethyl-1,3-propanediol, 1,4-cyclohexanedimethanol, phthalic anhydride and adipic acid. Mixtures of these reactive polyester or alkyd resins can be used. Alkyd resins are well known as shown by the "Encyclopedia Of Polymer Science And Technology," Vol. 1, 1964, John Wiley & Sons, Inc., pages 663–734; "Alkyd Resins," Martens, Reinhold Publishing Corporation, New York, 1961 and "Alkyd Resin Technology," Patton, Interscience Publishers, a division of John Wiley and Sons, New York, 1962. Some unsaturated polybasic acids and unsaturated polyols may be used in the condensation reaction but are generally undesirable. The reactive polyester or alkyd resin is usually added to the amino resin while dissolved or suspended in an organic solvent such as a mixture of a ketone and an alkyl acetate at about 60–80% solids.

The amino resin to be reacted with the reactive polyester is an alkylated benzoguanamine-formaldehyde, alkylated urea-formaldehyde or, preferably, an alkylated melamine-formaldehyde resin. Mixtures of these resins can be used. The alcohol used to modify the benzoguanamine-formaldehyde, urea-formaldehyde or melamine-formaldehyde resin can be n-butanol, n-propanol, isopropanol, ethanol or methanol and so forth. These amino resins are well known. Please see "Aminoplastics," Vale et al, Iliffe Books Ltd., London, 1964; "Amino Resins," Blair, Reinhold Publishing Corporation, New York, 1959, "Modern Plastics Encyclopedia 1980–1981," pages 15, 16 and 25 and "Encyclopedia Of Polymer Science And Technology," John Wiley & Sons, Inc., Vol. 2, 1965, pages 1 to 94.

Sufficient amounts by weight of the reactive polyester and amino resin are employed to provide a stain resistant, cross-linked layer having good durability and flexibility and having good adhesion to the compounded and plasticized vinyl chloride polymer layer on curing and crosslinking. These materials are cured at temperatures of at least about 200° F. for effective times in the presence of a minor amount by weight of an acidic catalyst like boric acid, phosphoric acid, acid sulfates, hydrochlorides, phthalic anhydride or acid, oxalic acid or its ammonium salts, sodium or barium ethyl sulfates, aromatic sulfonic acids such as p-toluene sulfonic acid (preferred) and the like. Prior to curing flatting agents or other additives can be added to the mixture of the reactive polyester and amino resin.

The stain resistant laminates of the present invention are particularly useful as wallcoverings especially for hospitals. However, these stain resistant laminates, also, can be used in the manufacture of tablecloths, shoe uppers, luggage exteriors, upholstery, vehicle interiors and seats, golf bags and other sporting goods and so forth.

The following examples will serve to illustrate the present invention with more particularity to those skilled in the art.

EXAMPLE 1

Homopolyvinyl chloride (PVC) containing plasticizer, stabilizer and other compounding agents was calender coated onto a cotton and polyester blend drill fabric at about 350° F. to form a plasticized and compounded PVC film about 4 mils thick on the fabric backing. Next the PVC layer was printed five times with heating at about 160° F. between each printing step to form a design on the surface of the PVC film. The printed film was then passed under an embossing roll and cooled to form an embossed pattern on the printed PVC film. The embossed and printed PVC film was then gravure finish roll coated with a solution of a reactive polyester (alkyd resin) containing carboxylic acid groups and an amino resin and cured at about 200° F. to remove the solvent and to form a stain resistant, crosslinked and adherent layer of about 0.5 mil thick on the embossed and printed PVC layer.

The mixture of the reactive polyester and amino resin contained the following ingredients:

| Ingredients | Weight % |
|---|---|
| Reactive polyester resin (80% resin, 20% solvent (mixture of methyl isobutyl ketone and n-butyl acetate)). The polyester was the condensation reaction product of 2,2-dimethyl-1,3-propanediol, 1,4-cyclohexane dimethanol, trimethylol propane, phthalic anhydride and adipic acid and contained active hydrogen atoms (—COOH groups). | 35.0 |
| Liquid hexamethoxymethyl melamine | 13.8 |
| p-Toluene sulfonic acid in isopropanol (40% acid, 60% alkanol) | 4.4 |
| Silicia gel flatting agent | 3.8–4.3 |
| Methyl ethyl ketone | 42.5–43 |

Test samples were cut from the laminated PVC composite, treated with staining agents and then washed to ascertain the effectiveness of the coating on rubbing with various cleaning agents.

TABLE 1

| Stain | Number of Hand Rubs to Remove Stain Cleaning Agents | | | |
|---|---|---|---|---|
| | A | B | C | D |
| Lipstick | NR | 20 | 10 | 6 |
| Shoe Polish | NR | NR | 10 | 4 |
| Iodine Solution # | 10 | 4 | 3 | 3 |
| Burn Cream ## | NR | NR | NR | 10* |
| Coffee/Tea (50:50 mixture in water) | 15 | 5 | 4 | 3 |
| Mustard | NR | NR | NR | 10 |
| Felt Tip Pen | NR | NR | 45 | 10 |
| Ball Point Pen | NR | NR | NR | 7 |
| Spray Paint (Enamel) | NR | NR | 10 | 5 |
| Permanent Stencil Ink | NR | NR | 30 | 6 |

Cleaning Agent A: Soap and water with 409 household type cleaner ###
Cleaning Agent B: Isopropyl Alcohol
Cleaning Agent C: Acetone/Water 50%/50% (fingernail polish remover)
Cleaning Agent D: 100% acetone
*slight stain barely perceptible

EXAMPLE 2

The method of this example was the same as that of Example 1, above, except that the outer layer of the solution of reactive polyester and amino resin was not applied to the embossed and printed layer on the PVC backed film. The results on testing are shown in Table 2, below:

TABLE 2

| Stain | Number of Hand Rubs To Remove Stains Cleaning Agents | | | |
|---|---|---|---|---|
| | A | B | C | D |
| Lipstick | NR | NR | Surface slightly damaged | Damaged surface |
| Shoe Polish | NR | NR | Surface slightly damaged | Damaged surface |
| Iodine Solution # | 15 | 10 | Surface slightly damaged | Damaged surface |
| Burn Cream ## | NR | NR | Surface slightly damaged | Damaged surface |
| Coffee/Tea (50:50 mixture in water) | 15 | 10 | Surface slightly damaged | Damaged surface |
| Mustard | NR | NR | Surface slightly damaged | Damaged surface |
| Felt Tip Pen | NR | NR | Surface slightly damaged | Damaged surface |
| Ball Point Pen | NR | NR | Surface slightly damaged | Damaged surface |
| Spray Paint (Enamel) | NR | NR | Surface slightly damaged | Damaged surface |
| Permanent Stencil Ink | NR | NR | Surface slightly damaged | Damaged surface |

Notes:
NR—no removal
10% solution of BETADINE, polyvinylpyrrolidone-iodine complex.
Anthralin (1, 8, 9-anthratriol). 1% in white petroleum jelly and unsaturated fatty acid base.
Strong cleaner, no phosphate, Chlorox Co.

We claim:

1. A laminate comprising

A. a first layer selected from the group consisting of a fabric backed compounded and plasticized vinyl chloride polymer layer and a compounded and plasticized vinyl chloride polymer layer free of a fabric backing and B. an outer second layer on and adherent to said first layer exhibiting stain resistance, durability and flexibility and comprising the crosslinked reaction product of at least one reactive polyester resin having free carboxylic acid groups and at least one amino resin selected from the group consisting of an alkylated benzoguanamine-formaldehyde resin, an alkylated urea-formaldehyde resin and an alkylated melamine-formaldehyde resin.

2. A laminate according to claim 1 wherein the surface of said first layer adjacent said outer layer has been printed at least one time.

3. A laminate according to claim 1 wherein the surface of said first layer adjacent said outer layer has been embossed.

4. A laminate according to claim 1 wherein the surface of said first layer adjacent said outer layer has been printed at least once and then embossed.

5. A laminate according to claim 1 wherein the surface of said first layer adjacent said outer layer has been embossed and then surface decorated.

6. A laminate according to claim 1 wherein said vinyl chloride polymer is homopolyvinyl chloride; said polyester resin is the condensation reaction product of 2,2-dimethyl-1,3-propanediol, 1,4-cyclohexane dimethanol, trimethylol propane, phthalic anhydride and adipic acid; said amino resin is liquid hexamethoxy methyl melamine and said first layer has first been calender coated onto a cotton and polyester blend drill fabric backing.

7. The method which comprises applying to the outer surface of a first layer selected from the group consisting of a fabric backed compounded and plasticized vinyl chloride polymer layer and a compounded and plasticized vinyl chloride polymer layer free of a fabric backing, a second layer of a catalyzed mixture of at least one reactive polyester resin having free carboxylic acid groups and at least one amino resin selected from the group consisting of an alkylated benzoguanamine-formaldehyde resin, an alkylated urea-formaldehyde resin and an alkylated melamine-formaldehyde resin, and heating said mixture to at least about 200° F. for a period of time sufficient to cure and crosslink said second layer to provide good adhesion of said second layer to said first layer and to provide said second layer with good stain resistance, durability and flexibility.

8. The method according to claim 7 where prior to applying said second layer to said first layer, said first layer is printed at least one time at a temperature of from about 150° to 165° F.

9. The method according to claim 7 where prior to applying said second layer to said first layer, said first layer is embossed under controlled preheating and precooling conditions.

10. The method according to claim 7 where prior to applying said second layer to said first layer, said first layer is printed at least one time at a temperature of from about 150° to 165° F. and then the printed first layer is embossed under controlled preheating and precooling conditions.

11. The method according to claim 7 where prior to applying said second layer to said first layer, said first layer is embossed under controlled preheating and precooling conditions and then said embossed layer is printed at least one time at a temperature of from about 150° to 165° F.

12. The method according to claim 7 wherein said vinyl chloride polymer is homopolyvinyl chloride; said polyester resin is the condensation reaction product of 2,2-dimethyl-1,3-propanediol, 1,4-cyclohexane dimethanol, trimethylol propane, phthalic anhydride and adipic acid; said amino resin is liquid hexamethoxy methyl melamine and said first layer has first been calender coated onto a cotton and polyester blend drill fabric.

13. The product produced by the method of claim 7.

14. The product produced by the method of claim 8.

15. The product produced by the method of claim 9.

16. The product produced by the method of claim 10.

17. The product produced by the method of claim 11.

18. The product produced by the method of claim 12.

19. A wall covering comprising

A. a first layer selected from the group consisting of a fabric backed compounded and plasticized vinyl chloride polymer layer and a compounded and plasticized vinyl chloride polymer layer free of a fabric backing and B. an outer second layer on and adherent to said first layer exhibiting stain resistance, durability and flexibility and comprising the crosslinked reaction product of at least one reactive polyester resin having free carboxylic acid groups and at least one amino resin selected from the group consisting of an alkylated benzoguanamine-formaldehyde resin, an alkylated urea-formaldehyde resin and an alkylated melamine-formaldehyde resin.

20. A wallcovering according to claim 19 wherein the surface of said first layer adjacent said outer layer has been printed at least one time.

21. A wallcovering according to claim 19 wherein the surface of said first layer adjacent said outer layer has been embossed.

22. A wallcovering according to claim 19 wherein the surface of said first layer adjacent said outer layer has been printed at least once and then the printed surface embossed.

23. A wallcovering according to claim 19 wherein the surface of said first layer adjacent said outer layer has been embossed and then surface decorated.

24. A wallcovering according to claim 19 wherein said vinyl chloride polymer is homopolyvinyl chloride; said polyester resin is the condensation reaction product of 2,2-dimethyl-1,3-propanediol, 1,4-cyclohexane dimethanol, trimethylol propane, phthalic anhydride and adipic acid; said amino resin is liquid hexamethoxy methyl melamine and said fabric backing is a cotton and polyester blend drill fabric.

* * * * *